US005888137A

United States Patent [19]

Bukle

[11] Patent Number: 5,888,137

[45] Date of Patent: Mar. 30, 1999

[54] SELF DEFENSE WEAPON

[76] Inventor: James C. Bukle, 1380 E. Ocotillo Dr., Sierra Vista, Ariz. 85635

[21] Appl. No.: 28,917

[22] Filed: Feb. 24, 1998

[51] Int. Cl.[6] ..... F41B 15/02

[52] U.S. Cl. ..... 463/47.2; 463/47.5

[58] Field of Search ..... 463/47.2, 47.3, 463/47.4, 47.5, 47.6, 47.7

[56] References Cited

U.S. PATENT DOCUMENTS

| | | |
|---|---|---|
| 1,909,932 | 5/1933 | Digel . |
| 3,323,796 | 6/1967 | Carlson . |
| 3,934,877 | 1/1976 | White . |
| 3,937,468 | 2/1976 | Conde, Sr. . |
| 4,132,408 | 1/1979 | Sabat . |
| 4,155,551 | 5/1979 | Smith . |
| 4,682,774 | 7/1987 | Holy . |
| 4,752,072 | 6/1988 | Parsons . |
| 5,086,377 | 2/1992 | Roberts . |
| 5,161,800 | 11/1992 | Parsons, et al. . |
| 5,465,960 | 11/1995 | Bickerton et al. . |
| 5,482,271 | 1/1996 | McNutt . |
| 5,542,667 | 8/1996 | Lezdey et al. . |

*Primary Examiner*—William M. Pierce
*Attorney, Agent, or Firm*—Richard C. Litman

[57] ABSTRACT

A self defense weapon comprising a base and a striking arm connected end to end by a pivot. The pivot allows the striking arm to move in only a single plane, between a collapsed position in which the striking arm is partially contained in a concave portion of the base, and an extended position in which the striking arm is fully extended. The striking arm is prevented from rotating past the extended position by the abutting of the two ends. Thus the striking arm is prevented from injuring the user's hand by having a length short enough that it does not overlap any of the handle in the closed position. A safety chain connects the base to the striking arm near the pivot, and prevents the striking arm from flying away from the base if the pivot breaks. A hook at the end of the handle fits around the user's hand, preventing an attacker from taking the weapon away from the user. Lastly, a key ring attached to the handle helps to disguise the function of the invention. In use, the weapon combines the simplicity and safety of a rigid stick, while providing the compactness, range, and striking force of a flailing weapon. The entire range of possible uses are available to the user by merely grabbing the handle, without any changes to the configuration of the weapon.

8 Claims, 3 Drawing Sheets

SELF DEFENSE WEAPON

BACKGROUND OF THE INVENTION

1. Field of the Invention

The present invention relates to the field of self-defense weapons. Specifically the invention is a folding metal bar which can be used as a blocking device, a rigid impact weapon, or a flailing impact weapon. The invention incorporates a handle designed to prevent an attacker from disarming the weapon's user, a safety chain to protect bystanders in the event the weapon breaks, and a means for disguising the weapon as something else. It combines the versatility of an advanced flailing weapon, while retaining the simplicity and ease of use of a rigid stick.

2. Description of the Related Art

Impact weapons are among the oldest and most widely used self-defense weapons known to man. Despite their age and widespread use, they continue to be improved on a regular basis even today.

Nearly every culture which practiced any martial art developed systems which use a stick of varying length, ranging from the six inch long Japanese yawara to the immensely popular six foot long staff. Obviously, the longer staff was preferred for fighting when it was practical to carry it, and when there was sufficient space to use it. Shorter sticks are obviously easier to carry and easier to use in confined spaces, but the shorter range exposes the user to greater danger from an opponent's weapon.

To improve on the shortcomings of the simple straight stick, people developed various flailing weapons. Examples include the Okinawan nunchaku, which uses two short sticks connected by a rope, and the Okinawan tonfa, which uses a short handle attached to one end of the long striking arm, perpendicular to the striking arm, and which is used by spinning the tonfa in the hand during a strike. In addition to increasing the power of a strike through the use of an extra pivot point, some of these weapons also increased the range of the weapon without increasing bulkiness. For example, a 12" nunchaku with a 3" cord can be carried as a compact 12" package, but gives a 27" range while in use. However, these weapons were more difficult to use, and posed a danger to the user if used improperly. There are recorded examples of criminals threatening police officers with nunchakus, and then only succeeding in hurting themselves. Today, the nunchaku is generally only taught to black belts in the martial arts who have first studied other weapons.

In addition to their fighting advantages, all of the aforementioned defensive weapons had the advantage of appearing to be an innocent everyday object rather than a weapon. People have frequently found it advantageous to be able to carry their weapons discreetly, either to surprise an attacker, or to avoid the appearance of belligerence when out in public. The staff could be a walking stick, the tonfa was the handle of a grinding stone, and the nunchaku could be a grain flail, horse's bit, or children's toy. Even today, the popularity of devices such as the KUBOTAN keychain is due primarily to their innocent appearance.

Telescoping weapons were invented as another way to overcome the dilemma of range verses burdensomeness. One of the first patented is described in U.S. Pat. No. 1,909,932, issued to Digel, which discloses a bludgeon using a flexible spring with a weight con one end, and which could be collapsed into a handle. More modern examples include U.S. Pat. No. 4,752,072, issued to Parsons, which discloses a telescoping metal rod which forms part of a keychain, and U.S. Pat. No. 5,161,800, issued to Parsons et al., which discloses an improved retainer clip for holding the '072 keychain in its collapsed position when not in use as a weapon. U.S. Pat. No. 4,682,774, issued to Holy, discloses a collapsible and recombinable martial arts weapon. In addition, U.S. Pat. No. 5,465,960, issued to Bickerton, discloses a side handle baton wherein the side handle folds into the main striking arm, and which has a telescopically extendable second handle. The Holy and Bickerton inventions fail to address the needs of defensive weapon users because their inventions are slow to convert from one configuration to another, preventing the user from reacting to a rapidly changing situation.

Jack M. Sabat disclosed a nunchaku in which the two sticks could be secured together to form a single nightstick with a length equal to the combined length of both sticks in U.S. Pat. No. 4,132,408. This device, however, requires some time to convert the weapon from a flailing weapon to a rigid weapon, so the user must know well in advance of being attacked which configuration will be desirable.

David J. Smith disclosed in U.S. Pat. No. 4,135,551 a nunchaku wherein one of the sticks is hollow, and the other stick can be inserted into the hollow section for storage or use as a nightstick. Smith's invention uses a detent means placed in the handles to lock the handles into position, enabling quick conversion from one mode of operation to another. The weapon does, of course, require the same advanced training as a conventional nunchaku.

Other patents related to the field of defensive impact weapons include: U.S. Pat. No. 3,934,877 issued to White for a nunchaku incorporating both rigid and flexible materials in different portions of the sticks; U.S. Pat. No. 5,086,377 issued to Roberts, disclosing a baton which includes a flashlight, an aerosol chemical irritant, and an alarm; U.S. Pat. No. 3,937,468, which discloses a nunchaku made from high density polypropylene, U.S. Pat. No. 5,542,667 issued to Lezdey, disclosing a martial arts training device; and U.S. Pat. No. 3,323,796 issued to Carlson, disclosing a jousting apparatus.

None of the above inventions and patents, taken either singularly or in combination, is seen to describe the instant invention as claimed. Thus a self defense weapon solving the aforementioned problems is desired.

SUMMARY OF THE INVENTION

The invention comprises two rods, one of which being a longer base, and the other being a shorter striking arm, connected end to end by a pivot. The striking arm is capable of pivoting in only one plane, and can be positioned either against a concave portion of the base for compact carrying, or extended to its full length for use. The striking arm is prevented from rotating past its fully extended position by the abutting of the end portions of the rods in this position. Additionally, the striking arm is not long enough to overlap the handle portion of the base in the collapsed position, preventing the possibility of accidently striking one's own hand during use.

To bring the weapon to bear, the user needs only to grab the handle. By swinging the above weapon within the plane in which the striking arm pivots, the user can strike with a flailing motion without the danger of losing control of the weapon, as otherwise exists with a nunchaku. By rotating the user's hand 90° and swinging perpendicular to this plane, the weapon is effectively a rigid stick. The user can block an opponent's attack merely by swinging the weapon towards his opponent's weapon, or by grabbing the end of the striking arm and using both hands to brace against the attack.

The preferred cross section of both rods, when viewed from cone end, is L-shaped. This cross section allows the base to partially contain the striking arm when collapsed, increasing the compactness of the invention. A suggested material is angled aluminum.

To provide for the safety of bystanders, the preferred embodiment of the invention includes a chain connecting the base and striking arm in addition to the pivot. If the pivot ever breaks while the weapon is in use, the chain will prevent the striking arm from flying away from the weapon and injuring a bystander.

The preferred embodiment also includes a hook on the end of the handle, which fits around the edge of the user's hand opposite the thumb. If an attacker grabs the weapon and attempts to pull it from the user, the hook will prevent the weapon from sliding out of the user's hand. This improvement is contrary to the current teachings of many martial arts, which discourage anything attached to a weapon which will hold a hand in place, preventing a quick grip change during a fight. While grip changes are fine for the advanced practitioner, the object of this invention is to provide a defensive weapon which is easily used by a wide variety of users.

To be truly useful, the weapon must be capable of being carried discreetly. Inconspicuous carry not only facilitates public relations for the user, but also gives the user the element of surprise if attacked. The invention therefore preferably includes a key ring to disguise it as something other than a weapon.

Accordingly, it is a principal object of the invention to provide a collapsible, readily available, safe, easy to use, and inconspicuous self defense weapon for use by law enforcement officers, probation officers, and law abiding citizens desiring an effective means of personal protection.

It is another object of the invention to provide a weapon with the simplicity and safety of a rigid stick, while also providing the compactness, range, and striking force of a flailing weapon.

It is a further object of the invention to provide for the safety of bystanders while the weapon is in use by preventing the weapon from flying apart if it breaks.

Still another object of the invention is to provide weapon which is difficult for an attacker to take away from its user.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
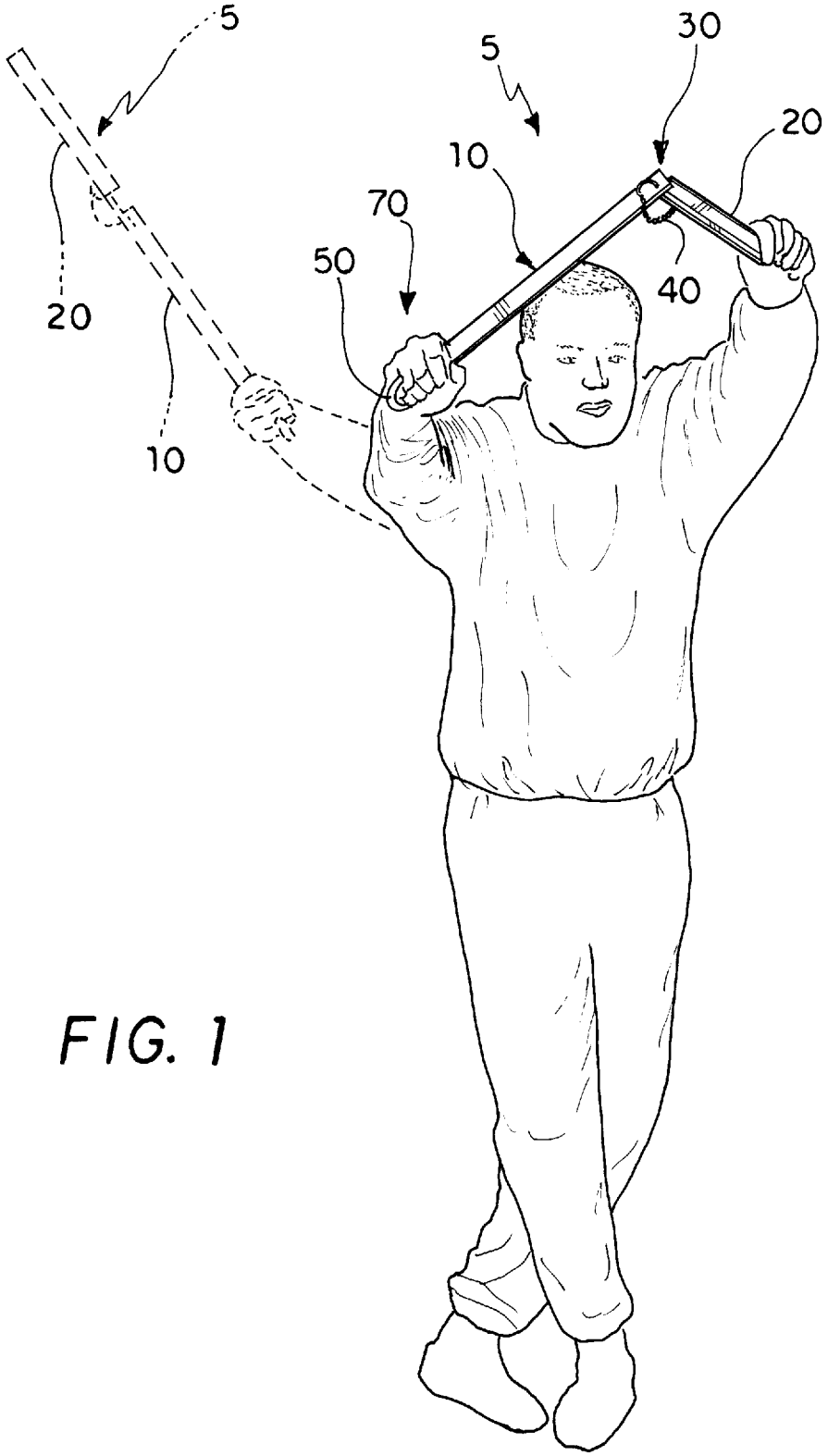
FIG. 1 is an environmental, perspective view of a self defense weapon according to the present invention.

As shown in the Figures together, the invention is a weapon 5 comprising generally of two portions, one of which being a longer base member 10 having end portion 80, and the other being a shorter striking arm 20 having end portion 90, connected end to end by a pivot 30. The pivot 30 may be any pivoting means which joins the striking arm 20 to the base member 10 such that the striking arm 20 is capable of pivoting in only one plane, which may be a simple pin passing through the end portions 80,90 of the striking arm 20 and base member 10.

Figure 2:
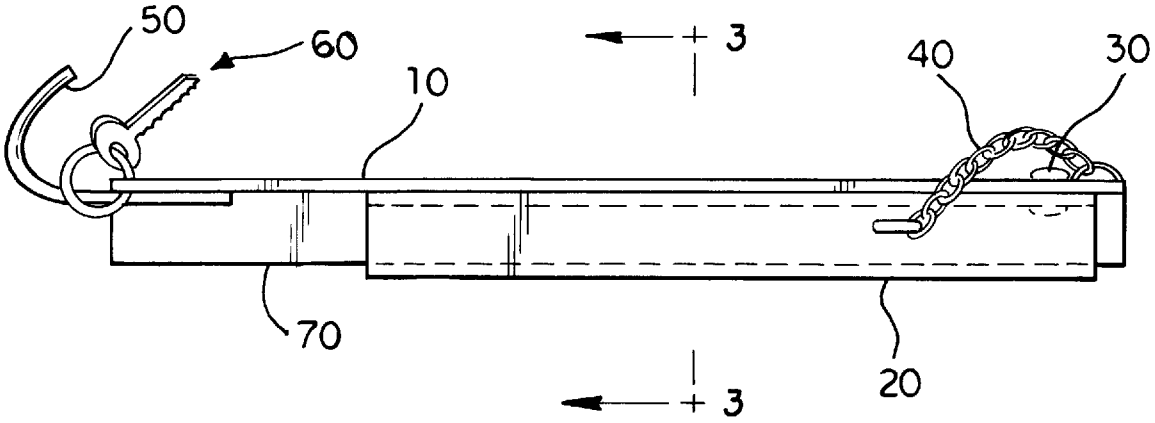
FIG. 2 is a side view of the weapon in its closed position, showing how it would appear to anyone observing it being carried.
Figure 3:
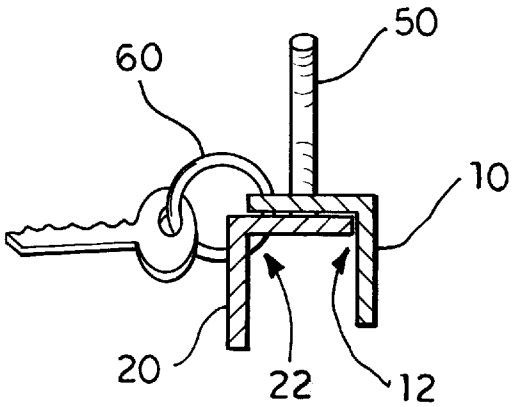
FIG. 3 is a cross-sectional view of the mid-section of the weapon along line 3—3 of FIG. 2, showing how the base and striking arm fit together.

The striking arm 20 and the base member 10 are dimensioned and configured to nest within one another. The preferred configuration is an L-shape in cross section, as best seen from FIG. 3, and are preferably made from aluminum for its light-weight characteristics, although other composite materials may also be suitable. The L-shape defines concave portion 12 of the base member 10, and concave portion 22 of the striking arm 20. This permits the striking arm 20 to rest within the concave portion 12 of the base member 10, creating a compact carrying state, as shown in FIGS. 2 and 3. The invention can be stored in this collapsed position, wherein it is both compact and ready for immediate use.

As can be readily appreciated from FIG. 2, the striking arm 20 is dimensioned to have a length significantly less than that of the base member 10 such that the base member defines a handle portion 70. The handle portion 70 is dimensioned to amply permit grasping by a human hand, wherein the striking portion 20 does not overlap the handle portion 70, allowing the user to grab the handle quickly and easily, and preventing the user from striking his own hand with the striking arm during a flailing strike. Moreover, a second end 24 of the striking arm 20 is rounded to minimize the possibility of injuring the grasping hand when the striking arm 20 returns to a nested state.

Figure 4:
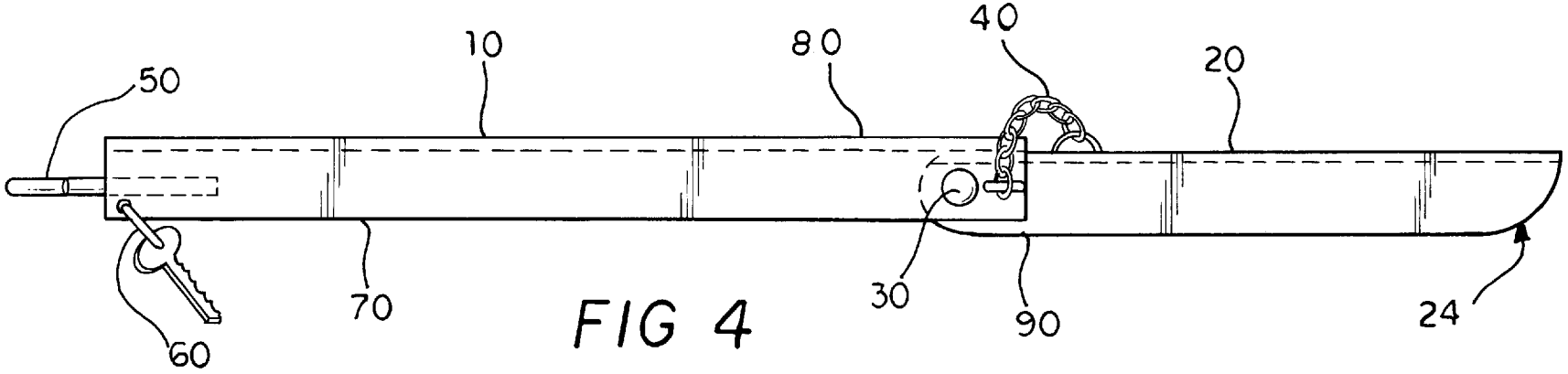
FIG. 4 is a top view of the weapon in its open position.
Figure 5:
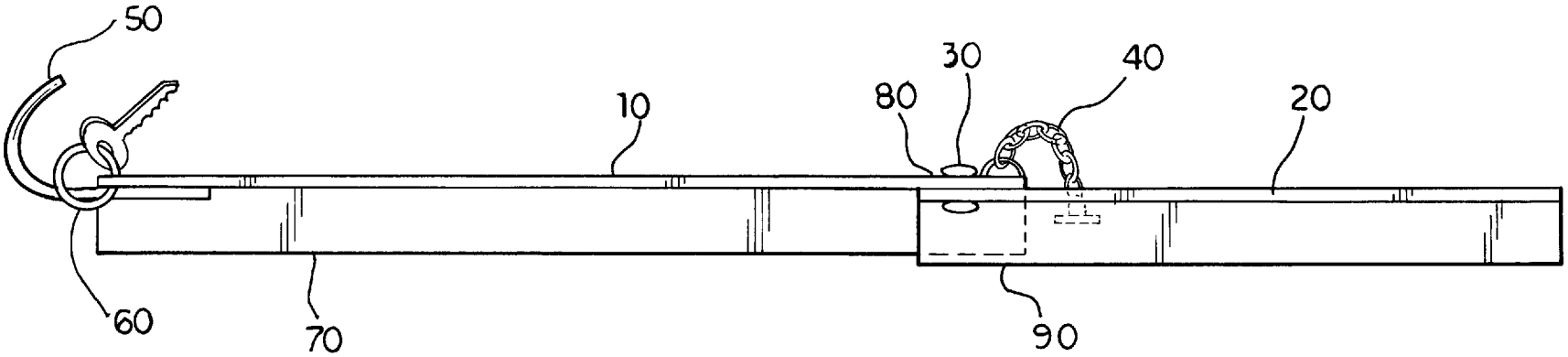
FIG. 5 is a side view of the weapon in its open position.

Referring momentarily to FIG. 1, once the user grabs the handle 70, he can strike immediately with a flailing motion, shown in phantom lines, arcing the striking arm 20 to an extended position as it travels towards its target. When extended as shown in FIGS. 4 and 5, the striking arm 20 is prevented from rotating past its fully extended position by the abutting of the end portions 80,90. In the preferred embodiment as shown in the Figures, the end portion 80 of base member 10 overlaps with the end portion 90 of the striking arm 20 to prevent rotation past the fully extended position. However, as the pivot 30 may be any pivoting means which joins the striking arm 20 to the base member 10 such that the striking arm 20 is capable of pivoting in only one plane, other embodiments may be possible, such as, for example, wherein each end abuts the other without overlapping.

Once in the extended position, the weapon 5 can be used as a rigid stick by striking perpendicular to the plane wherein the striking arm 20 rotates. In the preferred embodiment, this rigid relationship is permitted by the striking arm 20 being overlapped and resting in the concave portion 12 of the base member 10 in the extended state. Alternatively, the weapon 5 can be quickly and easily recollapsed for storage, or for another flailing strike, by reversing the above perpendicular twisting motion and swinging action.

FIGS. 2, 4, and 5 show a safety chain 40, which connects base end portion 80 with striking arm end portion 90. Any conventional means of attaching the safety chain 40 to the end portions 80,90 may be used, such as by a simple ring passing through a hole in the end portions as shown. In the preferred embodiment, this chain prevents the striking arm 20 from flying away from the weapon 5 and hitting a bystander if the pivot 30 breaks.

FIGS. 4 and 5 also show a hook 50 attached to the handle 70. The hook 50 is dimensioned and configured to fit around the edge of the user's hand opposing the thumb and nearest the little finger, thereby in use preventing the handle 70 from sliding out of the hand. The hook 50 is particularly useful if an opponent attempts to grab the weapon 5 and disarm the user. The hook 50 can also be used as the striking surface if the user throws a hammerfist strike.

The preferred embodiment also includes a key ring 60 attached to the handle 70 proximate the hook 50, shown in FIGS. 2 through 5. The key ring 60 serves to disguise the invention as something other than a weapon. If the weapon 5 were clipped to a clip board, the key ring 60 might make the invention look like a key chain intended to prevent carrying away the key.

Referring now to FIG. 1 with regard to some of the intended uses of the invention, the weapon 5 is shown in two of the multiplicity of possible states that it is capable of attaining while being used in self defense. As shown in solid lines, the weapon 5 is positioned to block an attack to the user's head, possibly against another impact weapon or a roundhouse punch. By grabbing each end of the weapon as illustrated, the user can throw a very well-supported block which positions him very well to deliver a counterattack. During counterattack, the weapon 5, as shown in the phantom portion of the Figure, is extended as either a flailing or rigid weapon.

The weapon 5 as used to block an attack to the user's head and counterattack, shows the base member 10 in the defender's right hand. The defender has also grabbed the striking arm 20 in his left hand to reinforce the block. The pivot 30 allows the defender to block with the base member 10 and striking arm 20 angled with respect to each other, allowing a horizontal head strike to slide over the top of the weapon without endangering the defender's hands. The defender can then counterattack with the invention, as shown in the phantom lines.

The limited pivot 30, allowing the striking arm 20 to rotate only in one plane, makes the above described block and counterattack easier and safer than with either a straight stick or a conventional flailing weapon. When a straight stick is grabbed by both ends for a block, the user must prevent the attacker's weapon from sliding in either direction, or the weapon will slide into one of the defender's hands. This forces the defender to meet the attacker's force head on, rather than placing the stick at an angle so that the attacker's weapon slides along the stick away from the defender's body. A pure flailing weapon would allow angling the blocking member as shown in the Figure, but the universal joint common to flailing weapons would make it difficult for the defender to brace both ends of the blocking member without specialized training. The current invention gives the defender the best of both worlds.

It is to be understood that the present invention is not limited to the sole embodiment described above, but encompasses any and all embodiments within the scope of the following claims.

I claim:

1. A self defense weapon comprising:

a base comprising of an elongated, rigid member, which has first end, a second end, a length between said ends, an end portion near said first end, a handle portion near said second end having a length, which has a concave portion along said length, said by having an L-shaped cross section;

a striking arm comprising an elongated, rigid member which has a first end, a second end, a length between said ends which is no longer than said length of said base minus said length of said handle portion, and a first and second end portion corresponding to said ends, said striking arm having an L-shaped cross section; and a pivot point connecting said first end portion of said base to said first end portion of said striking arm, providing for movement of said striking arm within the plane defined by said striking arm and said base between a first position where the striking arm is substantially contained within said concave section of said base, and a second position in which said striking arm is fully extended with said first end of said striking arm abutting said first end of said base.

2. The self-defense weapon described in claim 1, further comprising:

a hook dimensionally adapted to fit around the edge of a hand opposite the thumb and nearest the little finger, and depending from said second end portion of said base, wherein said hook is attached to said second end portion of said base.

3. The self-defense weapon described in claim 1, further comprising:

a key ring attached to said second end portion of said base.

4. The self-defense weapon described in claims 1, wherein:

said base and said striking arm are made out of angled aluminum rods.

5. The self defense weapon described in claim 1:

further comprising a key ring attached to the end of said base opposite said pivot point.

6. A self defense weapon 1, comprising:

a base being elongated and rigid, having a first end and a second end defining a length therebetween, an end portion near said first end, a handle portion near said second end, said base defining a concave portion along said length;

a striking arm being elongated and rigid, having a first end and a second end defining a length therebetween, said striking arm dimensioned in length no longer than said length of said base minus said length of said handle portion, and first and second end portions corresponding to said ends respectively;

a pivot means connecting said first end portion of said base to said first end portion of said striking arm, for pivotally moving said striking arm within a single plane between a first position wherein the striking arm is substantially contained within said concave section of said base, and a second position in which said striking arm is fully extended having said first end portion of said striking arm abutting said first end portion of said base; and a chain which connects said first end portion of said base to said first end portion of said striking arm.

7. A self-defense weapon comprising:

a base comprising an angled bar, having a first end and a second end defining a length therebetween, an end portion near said first end, a handle portion near said second end, and having a concave portion along said length;

a striking arm comprising angled bar, having a first end and a second end defining a length therebetween equal to the length of said base minus the length of said handle, and first and second end portions corresponding to said ends;

a pivot point connecting said first end portion of said base to said first end portion of said striking arm, for providing movement of said striking arm within a single plane between a first position wherein the striking arm is substantially contained within said concave section of said base, and a second position wherein said striking arm is fully extended with said first end of said striking arm abutting said first end of said base;

a hook attached to said second end portion of said base, depending so as to rest against the rearmost portion of the user's hand;

a chain connecting said first end portion of said base to said first end portion of said striking arm; and a key ring attached to said second end portion of said base.

8. The self defense weapon described in claim 7, wherein said angled bars are aluminum.

* * * * *